US008414155B2

(12) United States Patent
Catone et al.

(10) Patent No.: US 8,414,155 B2
(45) Date of Patent: Apr. 9, 2013

(54) LED LUMINAIRE

(75) Inventors: Robert Catone, St. Louis, MO (US); Charles S. Oldani, St. Louis, MO (US); Robert F. Hammer, St. Louis, MO (US); Timothy A. Stout, Sorento, IL (US); Robert Kloepple, St. Louis, MO (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 509 days.

(21) Appl. No.: 12/406,602

(22) Filed: Mar. 18, 2009

(65) Prior Publication Data

US 2010/0238671 A1 Sep. 23, 2010

(51) Int. Cl.
*F21V 5/04* (2006.01)
*F21V 29/00* (2006.01)

(52) U.S. Cl.
USPC ..... 362/249.03; 362/249.07; 362/373; 362/372; 362/294; 362/285

(58) Field of Classification Search ..... 362/249.03, 362/249.04, 249.07, 373, 372, 294, 285, 362/289, 418, 430, 800, 523
See application file for complete search history.

(56) References Cited

U.S. PATENT DOCUMENTS 1,652,347 A 12/1927 Champeau
2,456,179 A 12/1948 Finer
3,094,220 A 6/1963 Harling
3,533,062 A 10/1970 Coffman
3,643,079 A 2/1972 Glickman
3,752,974 A 8/1973 Baker et al.
3,797,914 A 3/1974 Aiken
3,798,436 A 3/1974 Gross
4,025,777 A 5/1977 Hayakawa
4,225,808 A 9/1980 Saraceni
4,433,328 A 2/1984 Saphir et al.
4,448,005 A 5/1984 Vochelli
4,499,529 A 2/1985 Figueroa
4,504,894 A 3/1985 Reibling
4,654,629 A 3/1987 Bezos et al.
4,943,900 A 7/1990 Gartner
4,982,176 A 1/1991 Schwarz
4,987,523 A 1/1991 Lindabury et al.
4,999,749 A 3/1991 Dormand
5,075,833 A 12/1991 Dormand
5,142,460 A 8/1992 McAtee
5,154,509 A 10/1992 Wulfman et al.
5,375,043 A 12/1994 Tokunaga
5,388,357 A 2/1995 Malita
5,390,092 A 2/1995 Lin
5,426,574 A 6/1995 Carolfi
5,450,302 A 9/1995 Maase et al.
5,463,280 A 10/1995 Johnson
5,575,459 A 11/1996 Anderson
5,580,163 A 12/1996 Johnson, II
5,607,227 A 3/1997 Yasumoto et al.
5,655,830 A 8/1997 Ruskouski
(Continued)

*Primary Examiner* — Bao Q Truong
(74) *Attorney, Agent, or Firm* — John F. Salazar; Mark L. Beloborodov

(57) ABSTRACT

A luminaire having a plurality of LED boards mounted within a housing is provided. Each LED board has at least one light emitting diode mounted thereon and an axis extending from a first end of the board to a second end of the board. Each LED board is adjusted about its respective axis to an orientation that is unique from at least two other LED boards.

26 Claims, 16 Drawing Sheets

U.S. PATENT DOCUMENTS 5,688,042 A 11/1997 Madadi et al.
5,726,535 A 3/1998 Yan
5,752,766 A 5/1998 Bailey et al.
5,785,411 A 7/1998 Komai et al.
5,790,040 A 8/1998 Kreier et al.
5,806,965 A 9/1998 Deese
5,810,463 A 9/1998 Kawahara et al.
5,890,794 A 4/1999 Abtahi et al.
5,918,970 A 7/1999 Brohard et al.
5,949,347 A 9/1999 Wu
6,068,383 A 5/2000 Robertson et al.
6,166,640 A 12/2000 Nishihira et al.
6,208,466 B1 3/2001 Liu et al.
6,220,722 B1 4/2001 Begemann
6,250,774 B1 6/2001 Begemann et al.
6,271,532 B1 8/2001 Trokhan et al.
6,276,814 B1 8/2001 Gough
6,305,109 B1 10/2001 Lee
6,325,651 B1 12/2001 Nishihara et al.
6,331,915 B1 12/2001 Myers
6,341,877 B1 1/2002 Chong
6,357,893 B1 3/2002 Belliveau
6,388,393 B1 5/2002 Illingworth
6,392,541 B1 5/2002 Bucher et al.
6,394,626 B1 5/2002 McColloch
6,431,728 B1 8/2002 Fredericks et al.
6,517,222 B1 2/2003 Orlov
6,520,655 B2 2/2003 Ohuchi
6,540,372 B2 4/2003 Joseph
6,577,072 B2 6/2003 Saito et al.
6,583,550 B2 6/2003 Iwasa et al.
6,585,395 B2 7/2003 Luk
6,628,352 B1 9/2003 Sumida et al.
6,666,567 B1 12/2003 Feldman et al.
6,703,795 B2 3/2004 Johnson
6,739,734 B1 5/2004 Hulgan
6,762,562 B2 7/2004 Leong
6,853,151 B2 2/2005 Leong et al.
6,860,628 B2 3/2005 Robertson et al.
6,893,139 B2 * 5/2005 Cercone et al. ..... 362/147
6,927,541 B2 8/2005 Lee
6,932,495 B2 8/2005 Sloan et al.
6,936,968 B2 8/2005 Cross et al.
6,942,361 B1 9/2005 Kishimura et al.
6,943,687 B2 9/2005 Lee et al.
6,948,840 B2 9/2005 Grenda et al.
6,979,105 B2 12/2005 Leysath
7,014,341 B2 3/2006 King et al.
7,021,787 B1 4/2006 Kuelbs
7,034,470 B2 4/2006 Cok et al.
7,049,761 B2 5/2006 Timmermans et al.
7,053,557 B2 5/2006 Cross et al.
7,067,992 B2 6/2006 Leong et al.
7,086,747 B2 8/2006 Nielson et al.
7,101,056 B2 9/2006 Pare
7,114,830 B2 10/2006 Robertson et al.
7,132,785 B2 11/2006 Ducharme
7,137,727 B2 11/2006 Joseph et al.
7,178,952 B2 2/2007 Bucher et al.
7,182,547 B1 2/2007 Leonhardt et al.
7,186,002 B2 3/2007 Matthews et al.
7,192,160 B2 3/2007 Reiff, Jr. et al.
7,195,367 B2 3/2007 Hong et al.
7,198,384 B2 4/2007 Kakiuchi et al.
7,207,690 B2 4/2007 Haugaard et al.
7,218,056 B1 5/2007 Harwood
7,241,038 B2 * 7/2007 Naniwa et al. ..... 362/525
7,249,865 B2 7/2007 Robertson
7,252,409 B2 8/2007 Kim
7,311,423 B2 12/2007 Frecska et al.
7,347,706 B1 3/2008 Wu et al.
7,431,482 B1 * 10/2008 Morgan et al. ..... 362/364
7,438,441 B2 10/2008 Sun et al.
7,931,388 B2 * 4/2011 Kanpurwala et al. .... 362/249.03
7,950,828 B2 * 5/2011 Zhang et al. ..... 362/294
7,972,035 B2 * 7/2011 Boyer ..... 362/289
2001/0012205 A1 8/2001 Lassovsky
2002/0047516 A1 4/2002 Iwasa et al.
2002/0136010 A1 9/2002 Luk
2002/0145878 A1 10/2002 Venegas, Jr.
2002/0176259 A1 11/2002 Ducharme
2002/0181231 A1 12/2002 Luk
2003/0021117 A1 1/2003 Chan
2003/0052599 A1 3/2003 Sun
2003/0102810 A1 6/2003 Cross et al.
2003/0137845 A1 7/2003 Leysath
2004/0007980 A1 1/2004 Shibata
2004/0062041 A1 4/2004 Cross et al.
2004/0080960 A1 4/2004 Wu
2004/0095078 A1 5/2004 Leong
2004/0107615 A1 6/2004 Pare
2004/0109330 A1 6/2004 Pare
2004/0120152 A1 6/2004 Bolta et al.
2004/0189218 A1 9/2004 Leong et al.
2005/0007024 A1 1/2005 Evans et al.
2005/0041424 A1 2/2005 Ducharme
2005/0073760 A1 4/2005 Kakiuchi et al.
2005/0078477 A1 4/2005 Lo
2005/0104946 A1 5/2005 Siegel
2005/0146899 A1 7/2005 Joseph et al.
2005/0162101 A1 7/2005 Leong et al.
2005/0169015 A1 8/2005 Luk et al.
2005/0201082 A1 9/2005 Mauk et al.
2005/0212397 A1 9/2005 Murazaki et al.
2005/0265023 A1 12/2005 Scholl
2005/0281030 A1 12/2005 Leong et al.
2006/0002106 A1 1/2006 Hong et al.
2006/0007682 A1 1/2006 Reiff, Jr. et al.
2006/0050528 A1 3/2006 Lyons et al.
2006/0092638 A1 5/2006 Harwood
2006/0221606 A1 10/2006 Dowling
2006/0285325 A1 12/2006 Ducharme et al.
2006/0291202 A1 12/2006 Kim
2007/0053182 A1 3/2007 Robertson
2007/0058358 A1 3/2007 Chikazawa et al.
2007/0076416 A1 4/2007 Leonhardt et al.
2007/0102033 A1 5/2007 Petrocy
2007/0114558 A1 5/2007 Lam
2007/0115654 A1 5/2007 Ruben
2007/0120135 A1 5/2007 Soules et al.
2007/0133202 A1 6/2007 Huang et al.
2007/0183156 A1 8/2007 Shan
2007/0285949 A1 12/2007 Lodhie et al.
2008/0062689 A1 * 3/2008 Villard ..... 362/250
2008/0074869 A1 3/2008 Okishima
2008/0184475 A1 8/2008 Sladick et al.
2008/0253124 A1 10/2008 Liao
2009/0040750 A1 2/2009 Myer
2009/0072970 A1 3/2009 Barton

* cited by examiner

LED LUMINAIRE

CROSS-REFERENCE TO RELATED DOCUMENTS

Not Applicable.

TECHNICAL FIELD

This invention pertains generally to a luminaire, and more specifically to an LED luminaire.

BRIEF DESCRIPTION OF THE ILLUSTRATIONS

DETAILED DESCRIPTION

Figure 1:
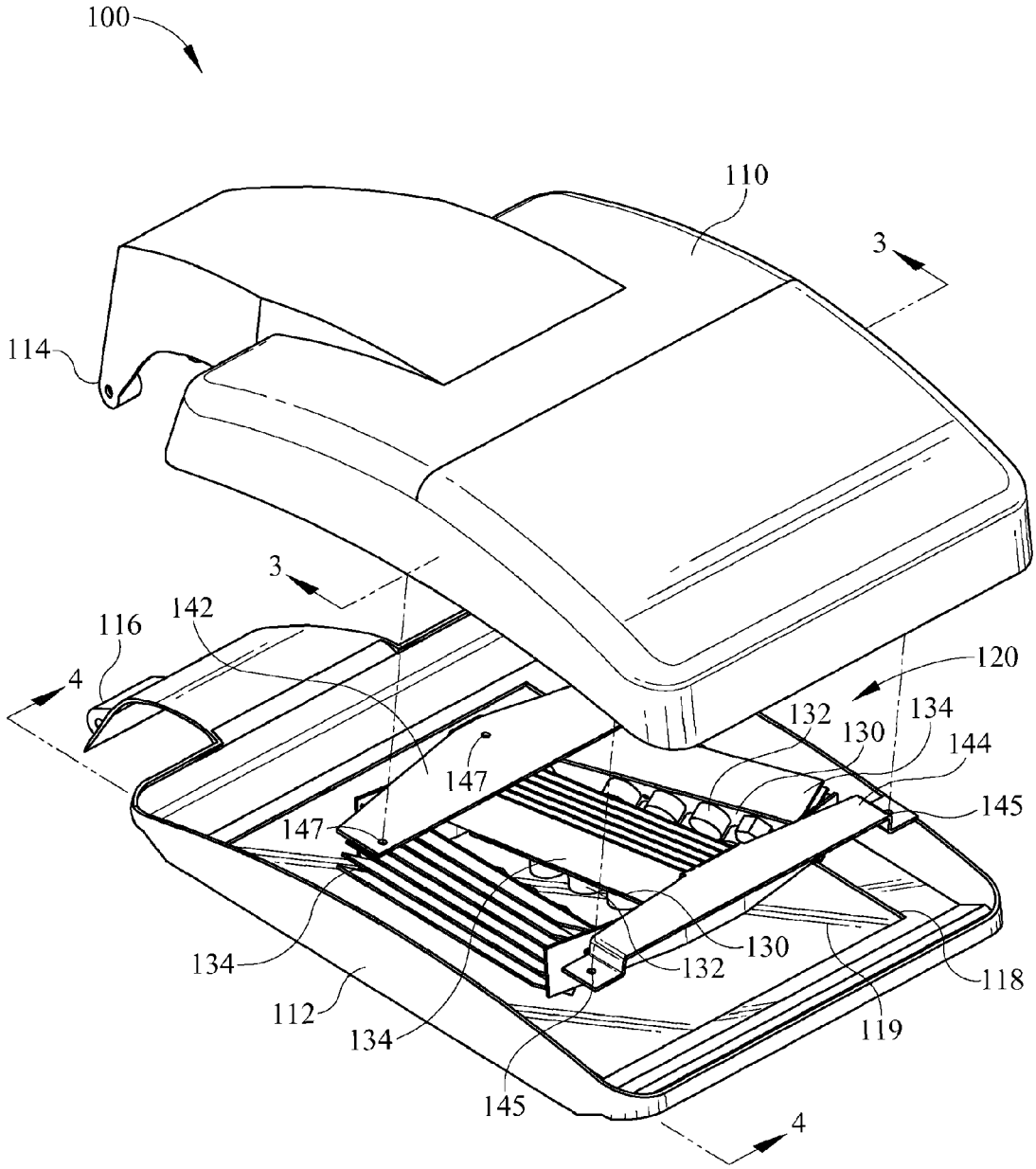
FIG. 1 is a perspective view of a first embodiment of the LED luminaire of the present invention shown with an upper housing exploded away.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

With reference to FIG. 1 through FIG. 4, a first embodiment of a LED luminaire 100 is depicted. LED Luminaire 100 has a housing having an upper housing portion 110 and a lower housing portion 112 that surround an LED structure 120. In some embodiments the housing is a Cobra Head RW601S/F Casting manufactured by Grandlite. Light emitted by LED structure 120 exits the housing through a light exit aperture 118, which in the depicted embodiment is formed in lower housing portion 112. Light exit aperture 118 defines a plane through which light exits LED luminaire 100. In some embodiments a lens 119 may be provided to fully enclose the housing and/or to alter optical characteristics of light exiting LED luminaire 100. In the depicted embodiment lens 119 lies substantially in the plane defined by light exit aperture 118. In other embodiments lens 119 may be at an angle with respect to light exit aperture 118 and not lie in the plane defined by light exit aperture 118. In yet other embodiments lens 119 may be concave, convex, or otherwise non-planar and not lie entirely in the same plane as light exit aperture 118. LED luminaire 100 is adapted to be secured to a pole or other mounting surface. Hinge element 114 is provided on upper housing portion 110 and hinge element 116 is provided on lower housing portion 112. Hinge elements 114 and 116 interact to enable hinged movement of upper and/or lower housing portions 110 and 112 to gain access to components of LED luminaire 100.

Figure 2:
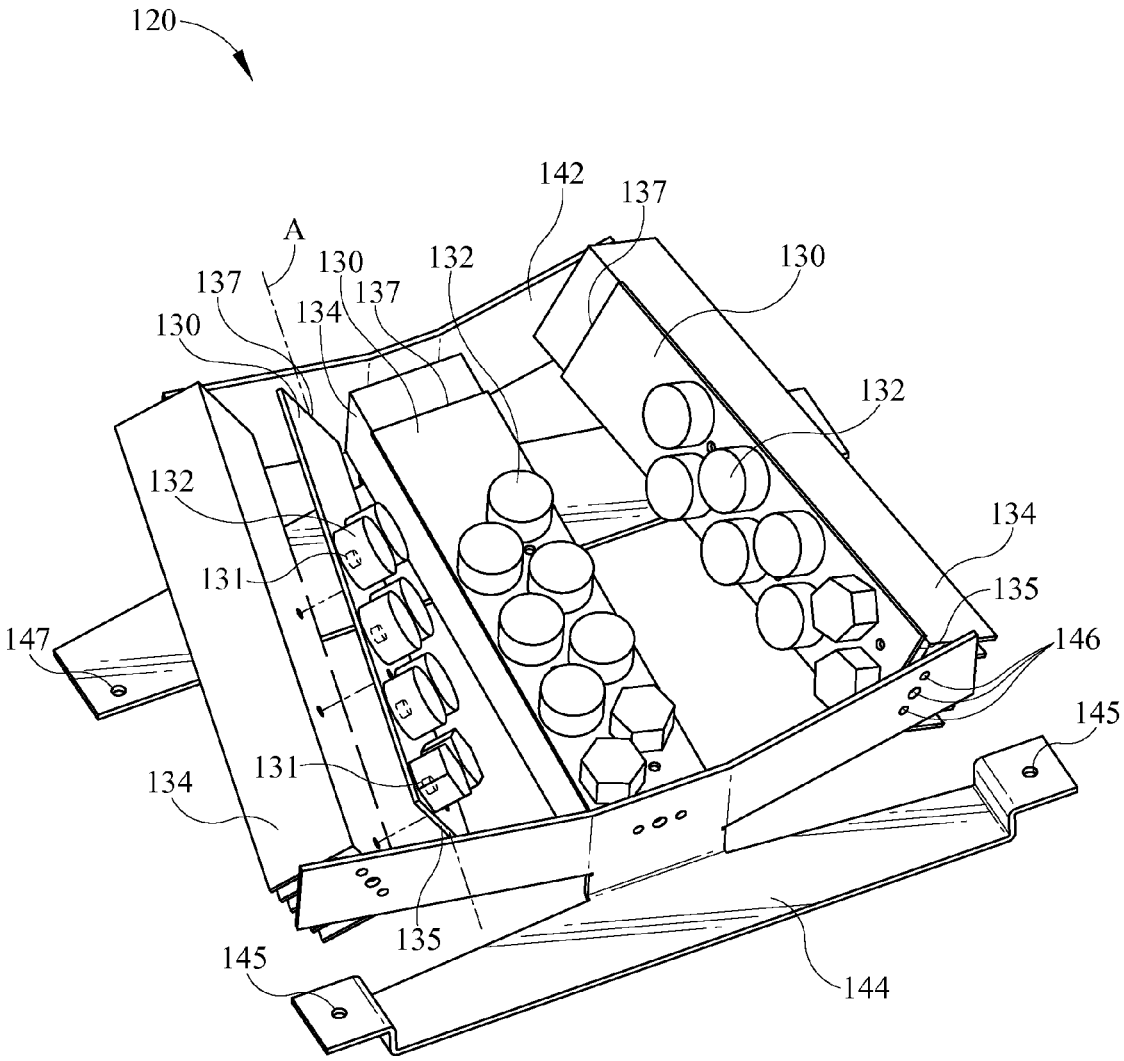
FIG. 2 is a perspective view of a LED structure of the LED luminaire of FIG. 1 shown with a single LED board exploded away.

With particular reference to FIG. 2, LED structure 120 has three LED strips, each having an LED board 130 in thermal connectivity with a heatsink 134. In the depicted embodiment of LED luminaire 100 heatsink 134 is an extruded aluminum heatsink manufactured by Aavid Thermalloy and is part number 61215 in their catalog. The heatsink has been cut to a length of approximately 7.875" and appropriate apertures have been drilled therein for attaching LED boards 130 to heatsink 134 and for attaching heatsink 134 to a first portion 144 of a master frame and a second portion 142 of the master frame, as described in more detail herein. In other embodiments alternative heatsink configurations may be used or heatsinks 134 may be omitted altogether if not desired for heat dissipation.

Each LED board 130 has eight LEDs 131 and corresponding optical pieces 132 paired with each LED 131. In FIG. 2 LEDs 131 are shown in phantom on the LED board 130 that is exploded away. The term "LED" as used herein is meant to be interpreted broadly and can include, but is not limited to, an LED of any color, any luminosity, and any light distribution pattern, and also includes, but is not limited to, an organic light emitting diode (OLED). In the depicted embodiment LEDs 131 are Luxeon Rebels part number LXML-PWN1-0080 having a Kelvin Color Temperature of approximately 4100K. Each LED is driven by a power supply at approximately 500 mA of current. In the depicted embodiment LED board 130 is a Thermalume metal core printed circuit board manufactured by Midwest Circuits and measures approximately 7.875" by 1.63". Although eight LEDs 131 and eight optical pieces 132 in a particular arrangement on LED board 130 are depicted, in other embodiments the number, arrangement, and/or configuration of LEDs 131 and/or optical pieces 132 on each LED board 130 may vary. Also, in other embodiments some or all of LEDs 131 on LED board 130 may be provided without a corresponding optical piece 132.

Each optical piece 132 may be individually configured to produce a given beam distribution when paired with a given LED 131 on a given LED board 130. In some embodiments each optical piece 132 and its corresponding LED 131 may be individually configured based on their orientation and positioning within LED luminaire 100. For example, in some embodiments some LEDs 131 and their corresponding optical piece 132 will be configured to produce a narrower beam spread, such as, for example, a twenty degree beam spread. For example, other LEDs 131 and optical pieces 132 will be configured to produce a wider beam spread, such as, for example, a one-hundred-and-twenty degree beam spread. Any LED 131 and optical piece 132 may be configured for conical beam distribution, non-conical beam distribution, symmetric beam distribution, and/or asymmetric beam distribution.

Any number of beam distributions and configurations may be present in LED luminaire 100. For example, in some embodiments each optical piece 132 and its corresponding LED 131 in LED structure 120 produce a beam distribution that is unique from the beam distribution of any other optical piece 132 and its corresponding LED 131. For example, in other embodiments all optical pieces 132 and their corresponding LED 131 in LED structure 120 produce the same beam distribution. For example, in yet other embodiments some optical pieces 132 in LED structure 120 share a first common configuration and other optical pieces 132 in LED structure 120 share a second common configuration. For example, in yet other embodiments some optical pieces 132 in LED structure 120 share a first common configuration, other optical pieces 132 in LED structure 120 share a second common configuration, other optical pieces 132 in LED structure 120 share a third common configuration, and a single optical piece 132 in LED structure 120 has a unique fourth configuration.

For example, in some embodiment the four LED optical pieces 132 on each LED board 130 that are closest a first end 135 of LED board 130 proximal to first portion 144 of the master frame are six degree LED collimator lenses. In some embodiments the six degree optical pieces are manufactured by Polymer Optics and are part number 120 in their catalog. It should be noted that "six degrees" refers to the half angle of the collimator lenses and not the full angle. In some embodiments the four LED optical pieces 132 on each LED board 130 that are closest to a second end 137 of LED board 130 proximal to second portion 142 of the master frame are twenty five degree LED collimator lenses. In some embodiments the twenty five degree optical pieces are Manufactured by Polymer Optics and are part number 124 in their catalog. It should be noted that "twenty five degrees" refers to the half angle of the collimator lenses and not the full angle. Other configurations of optical pieces 132 and/or LEDs 131 may be utilized to obtain desired optical output by LED luminaire 100.

Each LED board 130 and heatsink 134 is coupled between first portion 144 of a master frame and second portion 142 of the master frame. Apertures 146 are provided through first portion 144 for securing each heatsink 134 to first portion 144 with fasteners. In other embodiments LED board 130 and/or heatsink 134 may be welded or otherwise coupled to first portion 144. Similar couplings can be used between heatsink 134 and second portion 142. First portion 144 and second portion 142 are provided with securing apertures 145 and 147, respectively, for coupling first portion 144 and second portion 142 to upper housing 110 at supports 111 and 113 respectively. In other embodiments first portion 144 and/or second portion 142 may be otherwise secured to upper housing 110 and/or lower housing 112. An axis A, shown extending from the LED board 130 that is exploded away, extends through the center of each LED board 130 from first end 135 of LED board 130 proximal to first portion 144 to second end 137 of LED board 130 proximal to second portion 142.

Figure 3:
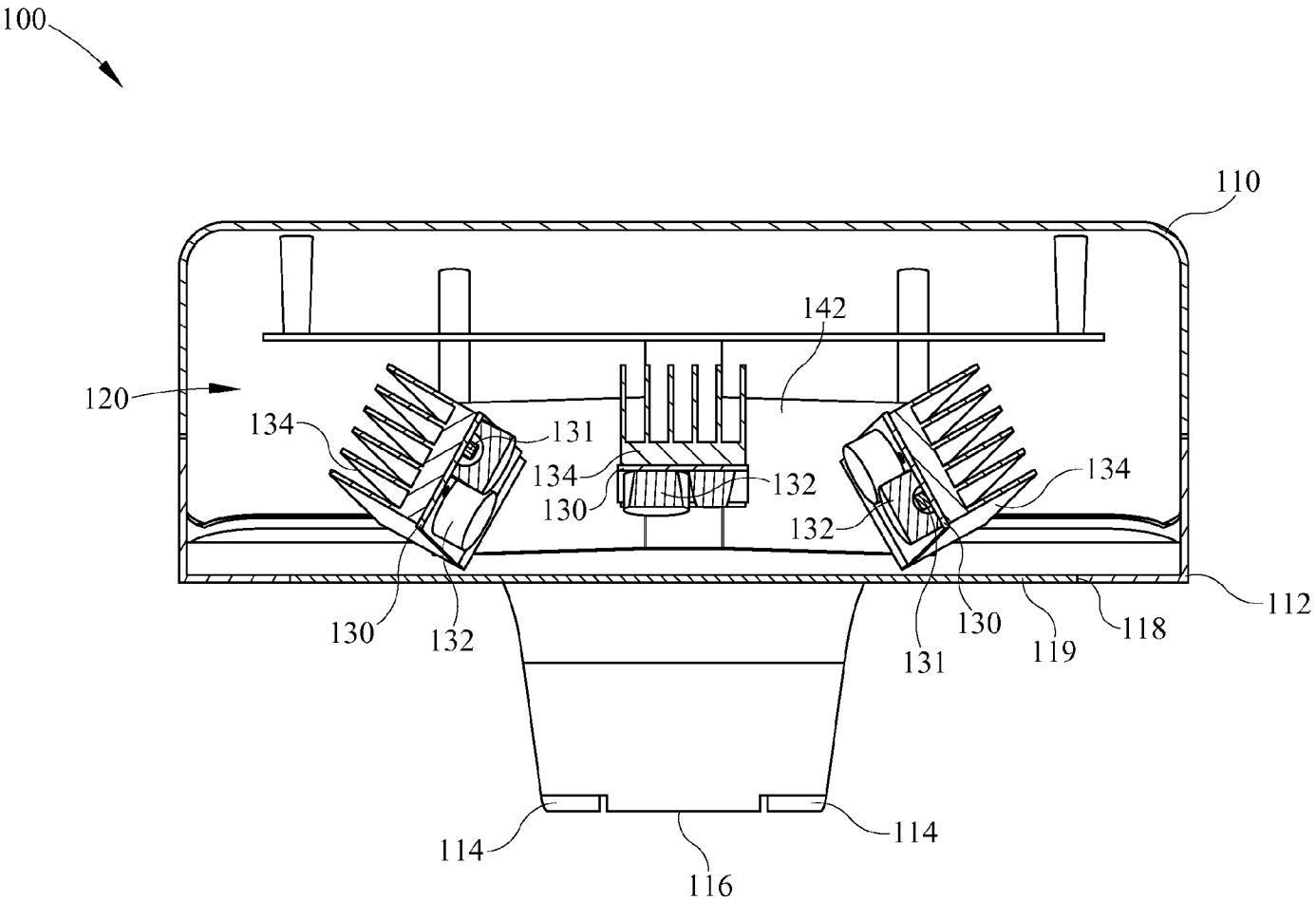
FIG. 3 is a front view, in section, of the LED luminaire of FIG. 1 taken along the section line 3-3 of FIG. 1.
Figure 4:
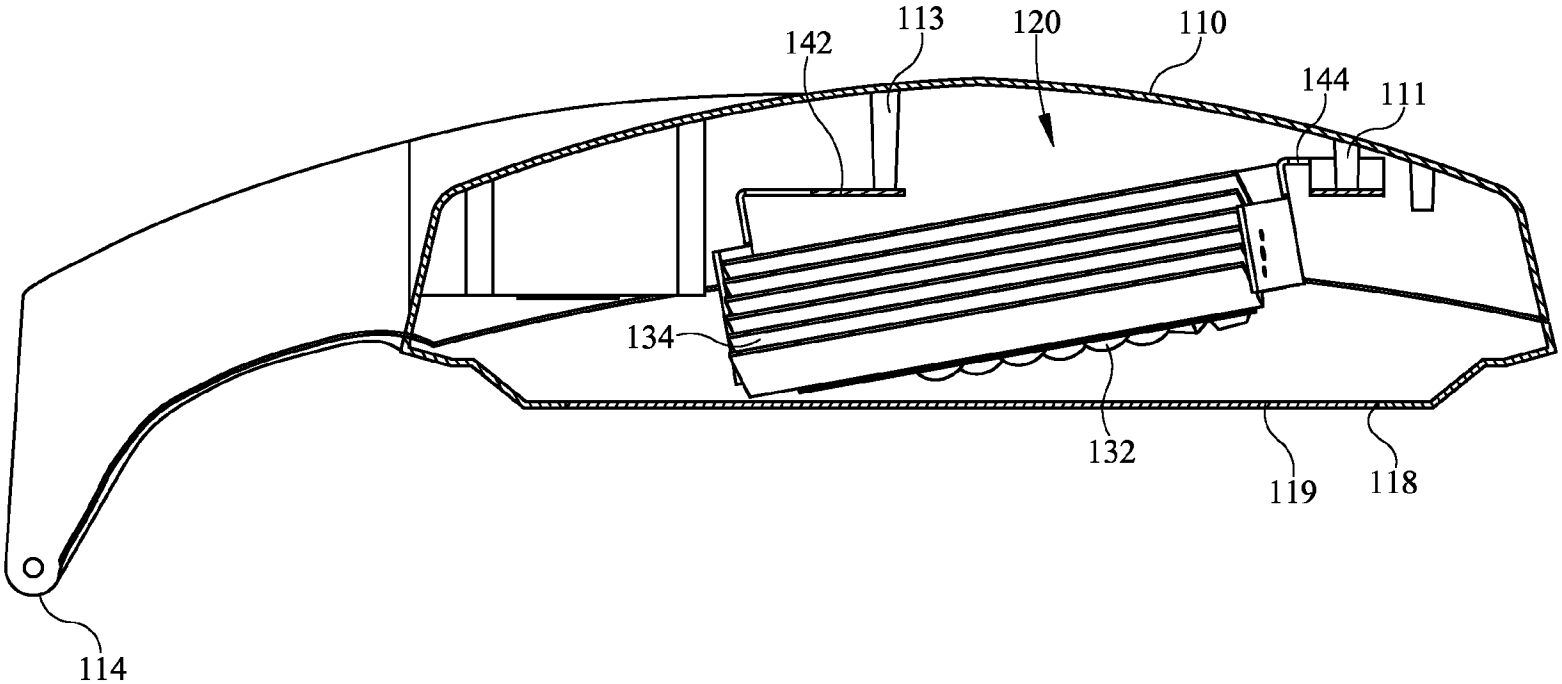
FIG. 4 is a side view, in section, of the LED luminaire of FIG. 1 taken along the section line 4-4 of FIG. 1.
Figure 5:
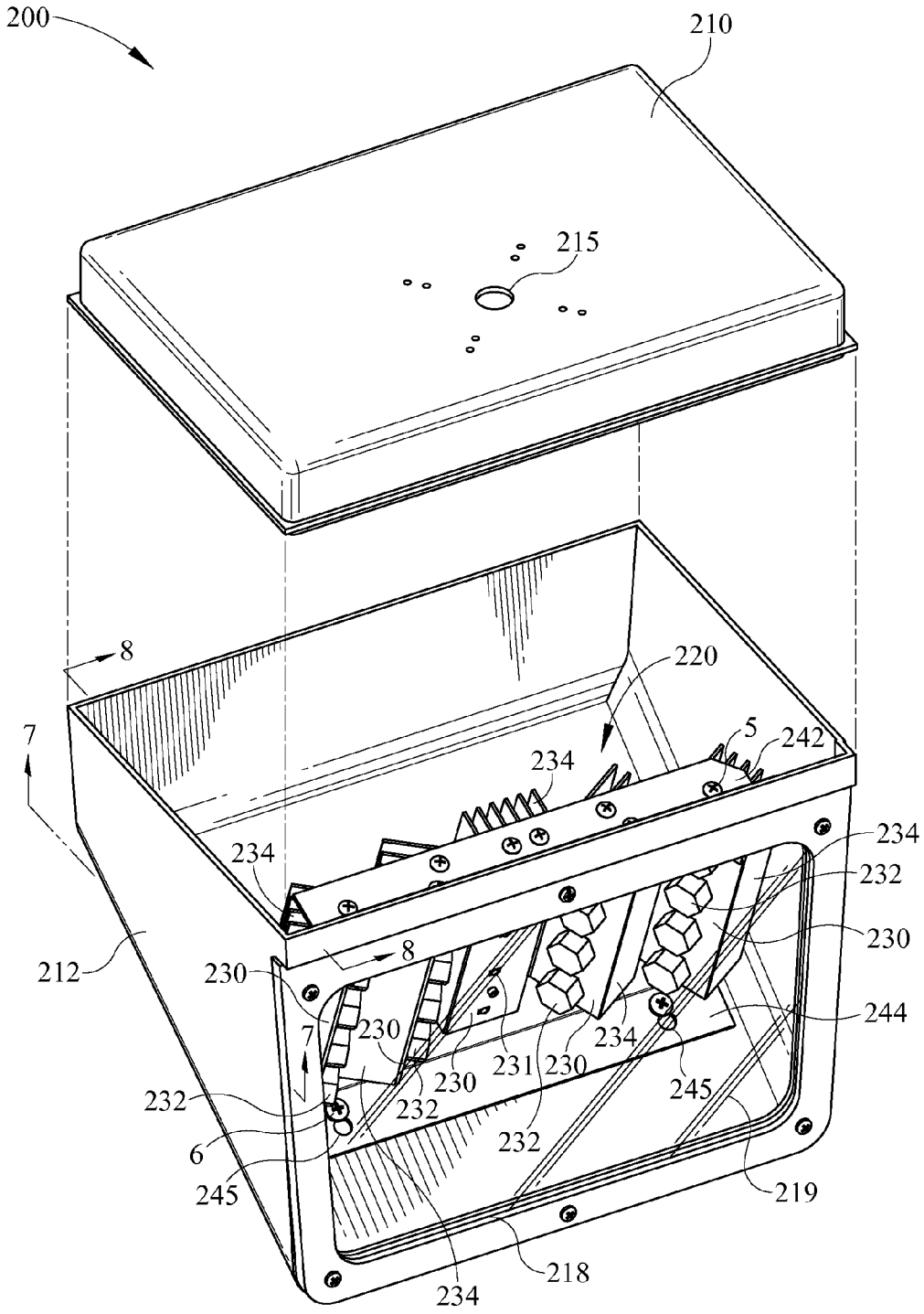
FIG. 5 is a perspective view of a second embodiment of the LED luminaire of the present invention shown with a rear housing exploded away.

With particular reference to FIG. 2 and FIG. 3, it can be seen that each LED board 130 is adjusted about its respective axis to an orientation that is unique from the orientation of other LED boards 130. The outside LED boards 130 are adjusted about their respective axes to an orientation that is approximately sixty degrees off from the orientation of the center LED board 130. Moreover, the outside LED boards 130 are adjusted approximately sixty degrees in opposite directions about their respective axes to orientations that are unique from one another. With particular reference to FIG. 2 it can be seen that the axes corresponding to each LED board 130 are at non-parallel angles with respect to one another. The axes of the two outside LED boards 130 are each at approximately a ten degree angle with respect to the axis of the center LED board 130 and the axes of the two outside LED boards 130 are at approximately a twenty degree angle with respect to one another. With particular reference to FIG. 4, it can further be seen that the axes of LED boards 130 are at approximately a twenty degree angle with respect to the plane defined by light exit aperture 118. The axes of LED boards 130 all lie in substantially the same plane due to all LED boards 130 being at a common angle with respect to light exit aperture 118 and all LED boards 130 being a common distance away from light exit aperture 118. Although approximate positionings of each LED board 130 have been described, other positionings may be used to obtain desired optical output from LED luminaire 100. Moreover, a variety of combinations of LEDs 131 and/or optical pieces 132 can be used to obtain desired beam distributions and desired optical output from LED luminaire 100.

With reference to FIG. 5 through FIG. 8, a second embodiment of a LED luminaire 200 is depicted. LED Luminaire 200 has a housing having a rear housing portion 210 and a front housing portion 212 that surround an LED structure 220. In some embodiments the housing is a WPC15 casting manufactured by QSSI. Light emitted by LED structure 220 exits the housing portion through light exit aperture 218, which in the depicted embodiment is formed in front housing portion 212. Light exit aperture 218 defines a plane through which light exits LED luminaire 200. In some embodiments a lens 219 may be provided to fully enclose the housing and/or to alter optical characteristics of light exiting LED luminaire 200. LED luminaire 200 is adapted to be secured to a junction box, wall, or other mounting surface. Front housing portion 212 is designed to removably engage rear housing portion 210. A wire throughway 215 allows electrical wiring into LED luminaire 200 to provide power to LED structure 220. In some embodiments electrical wiring entering LED luminaire 200 may directly feed LED structure 220. In some embodiments electrical wiring entering LED luminaire 200 may feed a sixty watt power supply within LED luminaire 200, which then feeds LED structure 220. In some embodiments the sixty watt power supply may be manufactured by Heyboer Transformers, part number HTS-9162. For simplification no power supply is shown in LED luminaire 200 or any other embodiments, but it is understood that power supplies may be easily included in, or remote to, any housings of the described embodiments.

Figure 6:
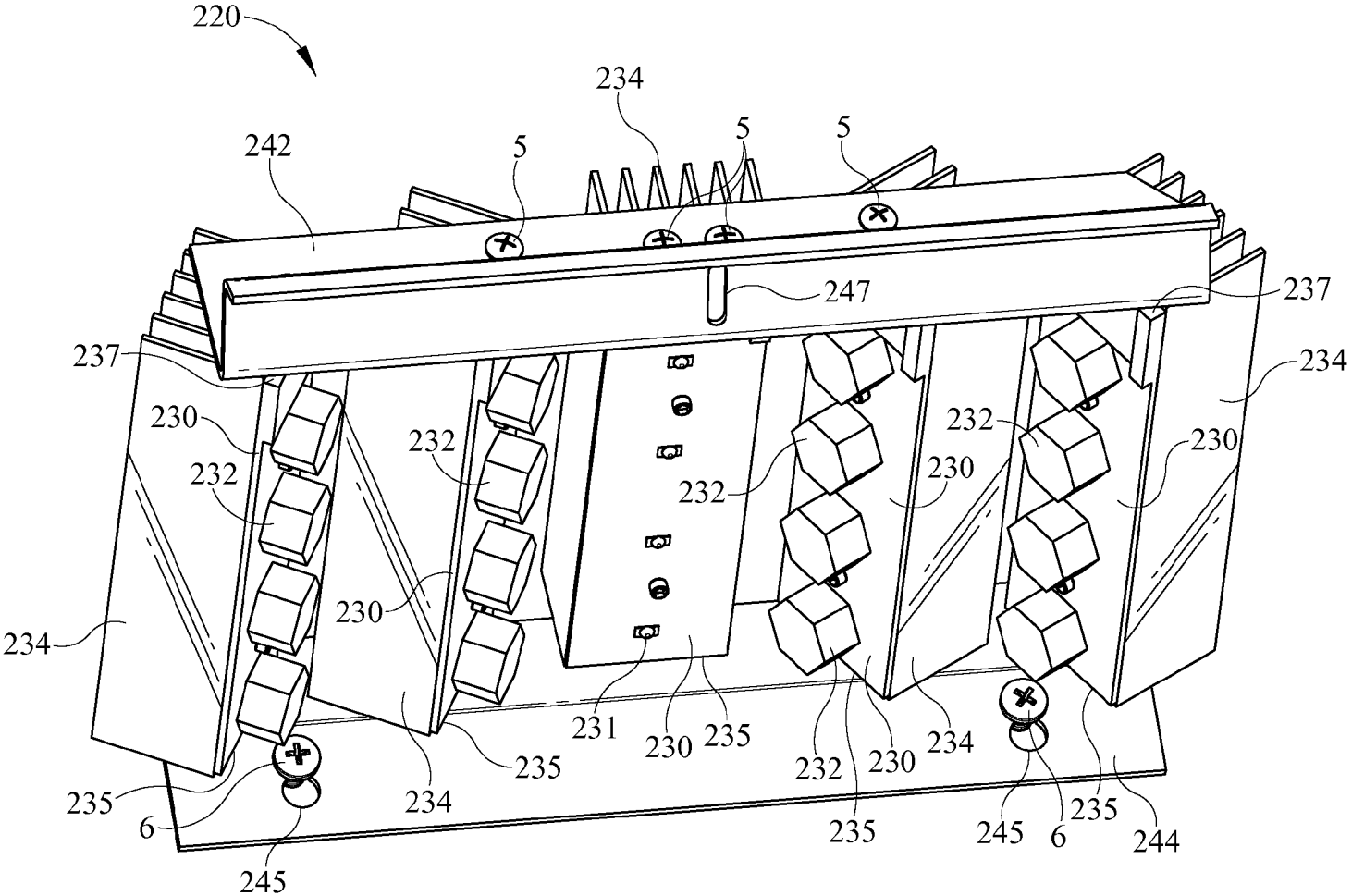
FIG. 6 is a perspective view of a LED structure of the LED luminaire of FIG. 5.

With particular reference to FIG. 6, LED structure 220 has five LED strips, each having an LED board 230 in thermal connectivity with a heatsink 234. In the depicted embodiment of LED luminaire 100 heatsink 134 is an extruded aluminum heatsink manufactured by Aavid Thermalloy and is part number 61215 in their catalog. The heatsink has been cut to a length of 5.75" and appropriate apertures have been drilled therein for attaching LED boards 230 to heatsink 234 and for attaching heatsink 234 to a first portion 244 of a master frame and a second portion 242 of the master frame, as described in more detail herein. In other embodiments alternative heatsink configurations may be used, or heatsinks 234 may be omitted altogether if not desired for heat dissipation.

Each LED board 230 has four LEDs 231 and four of the LED boards 230 have corresponding optical pieces 232 paired with each LED 231. In the depicted embodiment LEDs 131 are Luxeon Rebels part number LXML-PWN1-0080 having a Kelvin Color Temperature of approximately 4100K. Each LED is driven by a power supply at approximately 500 mA of current. In the depicted embodiment LED board 130 is a Thermalume metal core printed circuit board manufactured by Midwest Circuits and measures approximately 5.75" by 1.63". The middle LED board 230 does not have optical pieces 232 paired with its LEDs 231. Although four LEDs 231 in a particular arrangement on LED board 230 are depicted, in other embodiments the number, arrangement, and/or configuration of LEDs 231 and/or LED boards 230 may vary. Also, in other embodiments some or all of LEDs 231 on LED boards 230, beside the LEDs 231 on center LED board 230, may be provided without a corresponding optical piece 232.

As described with the first embodiment, each optical piece 232 on an LED board 230 may be individually configured to produce a given beam distribution when paired with a given LED 231. Also, each LED 231 not paired with an optical piece 232 may be individually configured to produce a desired beam distribution. Each optical piece 232 and LED 231 may be individually configured based on their orientation and positioning within LED luminaire 200. For example, in some embodiments all four LED optical pieces 232 on the two outermost LED boards 230 are six degree LED collimator lenses. In some embodiments the six degree optical pieces are Manufactured by Polymer Optics and are part number 220 in their catalog. Again, "six degrees" refers to the half angle of the collimator lenses and not the full angle. In some embodiments all four LED optical pieces 232 on the two LED boards 230 immediately adjacent the center LED board 230 are twenty five degree LED collimator lenses. In some embodiments the twenty five degree optical pieces are Manufactured by Polymer Optics and are part number 224 in their catalog. Again, "twenty five degrees" refers to the half angle of the collimator lenses and not the full angle. Other configurations of optical pieces 232 and/or LEDs 231 are contemplated and may be utilized to obtain desired optical output by LED luminaire 200.

Each LED board 230 and heatsink 234 is coupled between a first portion 244 of a master frame and a second portion 242 of the master frame. First portion 244 and second portion 242 are provided with securing apertures 245 and 247, respectively, for coupling first portion 244 and second portion 242 to front housing 212. Fasteners, such as screws 6 can extend through securing apertures 245 and/or 247 for coupling first portion 244 and/or second portion 242 to front housing 212. In other embodiments first portion 244 and/or second portion 242 may be otherwise secured to front housing 212 and/or rear housing 210. Screws 5 extend through apertures in second portion 242 and secure each heatsink 234 to second portion 242 with fasteners. In other embodiments LED board 230 and/or heatsink 234 may be welded or otherwise coupled to second portion 242. Also, in other embodiments LED boards 230 and/or heatsinks 234 may be directly coupled to front housing 212 and/or rear housing 210 or otherwise coupled to LED luminaire 200. Similar couplings can be used between heatsink 234 and first portion 244. An axis extends through the center of each LED board 230 extending from a first end 235 of LED board 230 proximal to first portion 244 to a second end 237 of LED board 230 proximal to second portion 242.

Figure 7:
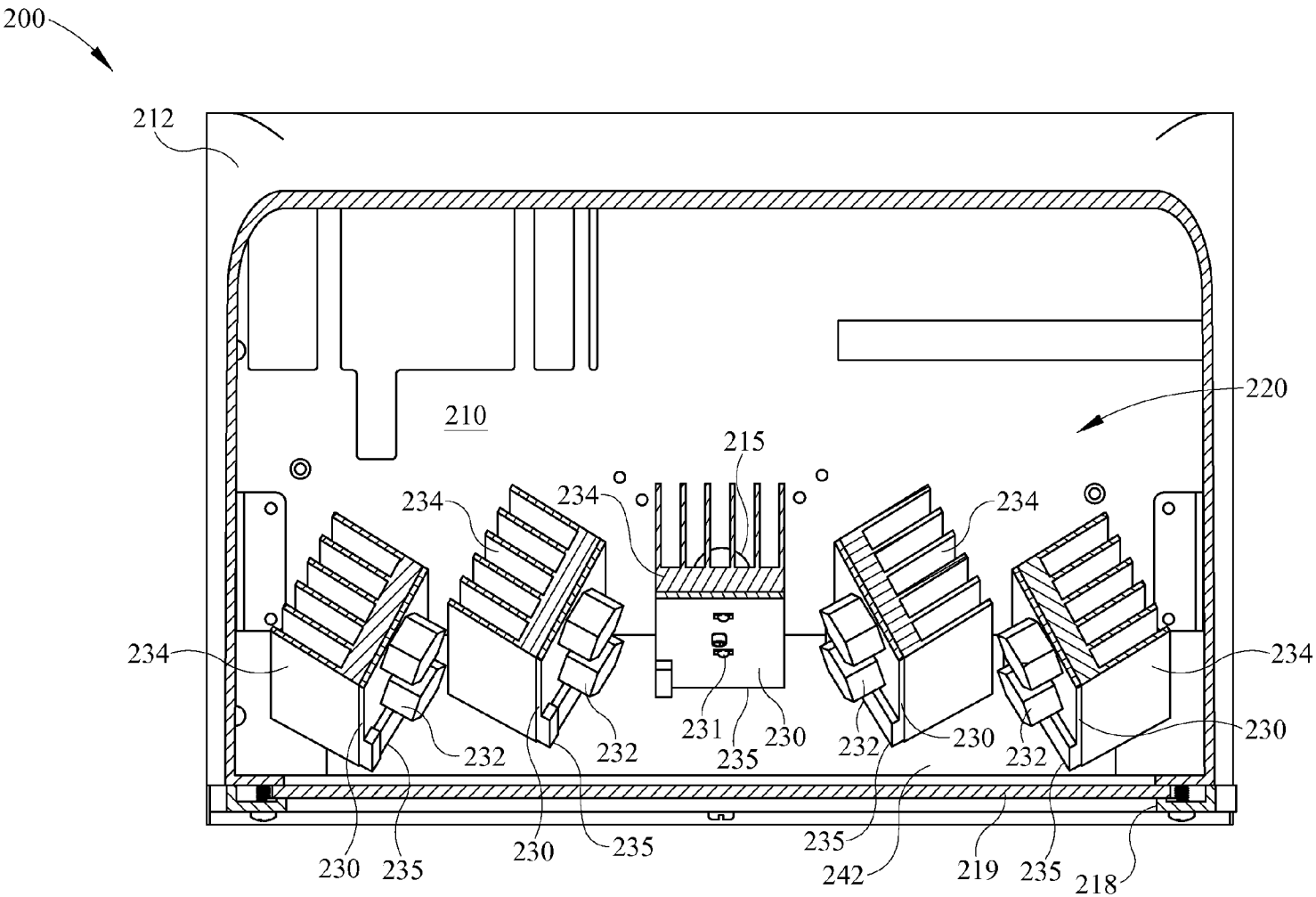
FIG. 7 is a front view, in section, of the LED luminaire of FIG. 5 taken along the section line 7-7 of FIG. 5.
Figure 8:
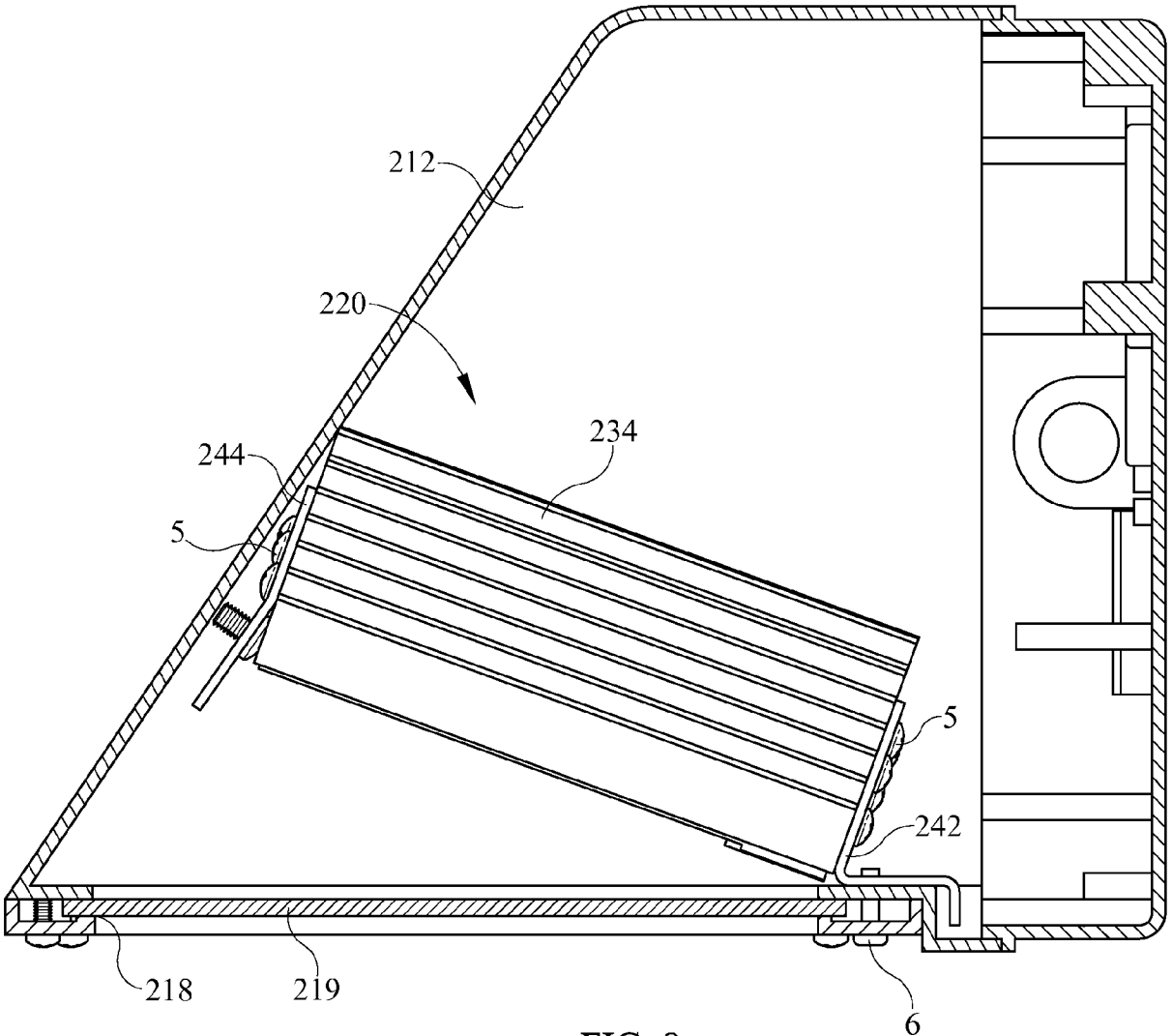
FIG. 8 is a side view, in section, of the LED luminaire of FIG. 5 taken along the section line 8-8 of FIG. 5.

With particular reference to FIG. 6 and FIG. 7, it can be seen that the middle LED board 230 is adjusted about its axis to a first orientation, two of the LED boards 230 on a first side of the middle LED board 230 are adjusted about their axes to a second orientation, and two of the LED boards 230 on a second side of the middle LED board 230 are adjusted about their axes to a third orientation. The LED boards 230 on a first side of the middle LED board 230 are adjusted about their axes to an orientation that is approximately sixty-five degrees off in a first direction from the orientation of the center LED board 230. The LED boards 230 on a second side of the center LED board 230 are adjusted about their axes to an orientation that is approximately sixty-five degrees off in a second direction from the orientation of the center LED board 230. In some embodiments the orientation of a given LED board 230 about its own axis can be fixedly adjusted per customer's specifications to achieve a desired optical output. With particular reference to FIG. 6, it can be seen that the axes corresponding to LED boards 230 are substantially parallel with respect to one another. With particular reference to FIG. 8, it can further be seen that the axes of LED boards 230 are at approximately a twenty degree angle with respect to the plane defined by light exit aperture 218. However, the axes of LED boards 230 do not all lie in the same plane. Although all LED boards 230 are at substantially the same angle with respect to light exit aperture 218, the axes of the two exterior LED boards 230 are positioned closer to light exit aperture 218 than the axes of the other three LED boards 230. Although approximate positionings of each LED board 230 have been described, other positionings may be used to obtain desired optical output from LED luminaire 200.

In other embodiments of LED luminaire 200 the two LED boards 230 immediately adjacent the center LED board may be omitted from LED luminaire 200. In yet other embodiments of LED luminaire 200 the middle LED board 230 may be provided with twenty five degree LED collimator lens optical pieces 232 paired with the two LEDs 231 that are closest to second portion 242 of the master frame. In yet other embodiments the two LED boards 230 immediately adjacent the center LED board 230 may be adjusted about their axes to an orientation that is approximately forty-five degrees off from the orientation of the center LED board 230 and the two outermost LED boards 230 may be adjusted about their axes to an orientation that is approximately sixty-five degrees off from the orientation of the center LED board 230.

Figure 9:
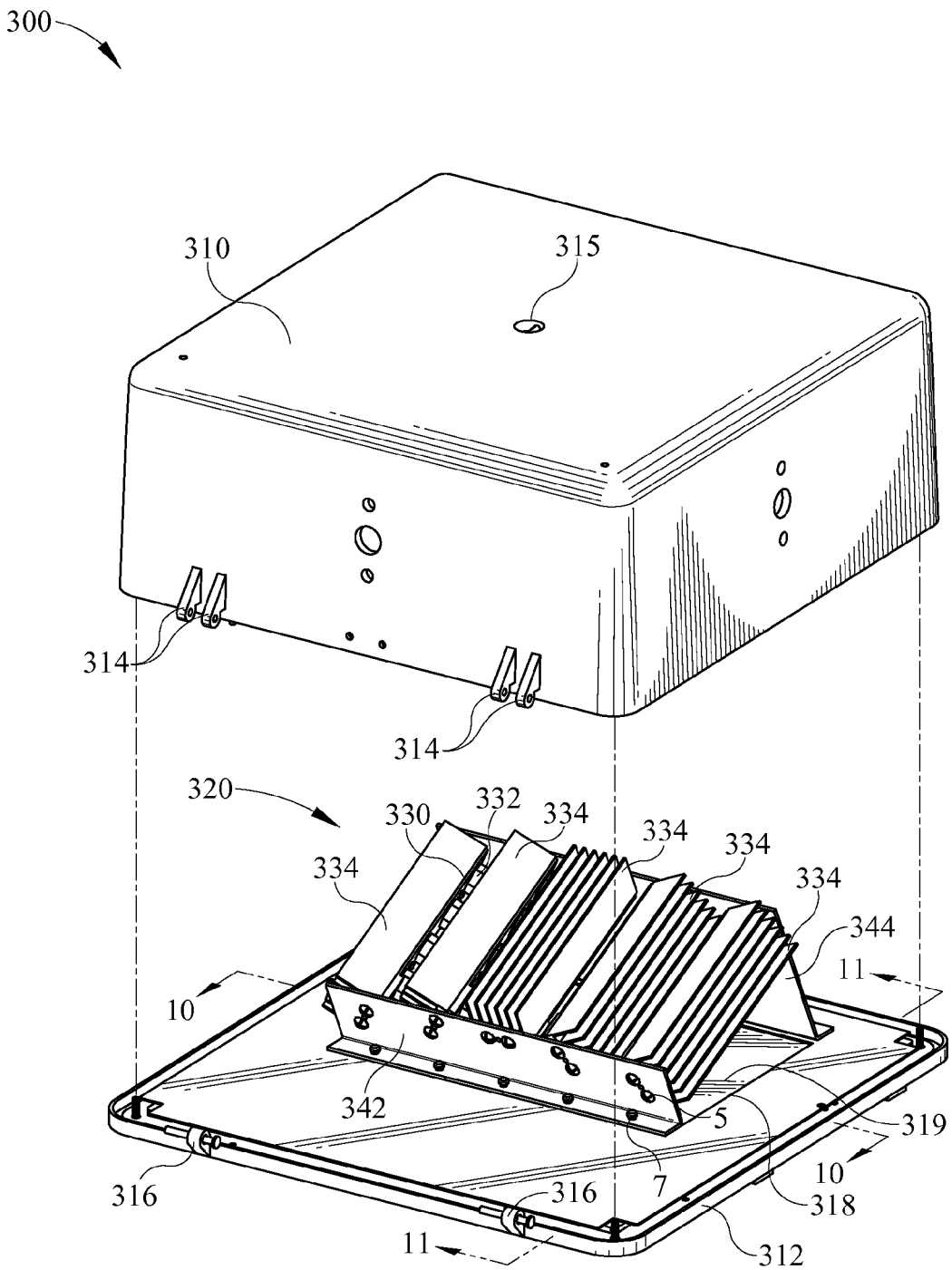
FIG. 9 is a perspective view of a third embodiment of the LED luminaire of the present invention shown with an upper housing portion exploded away.
Figure 10:
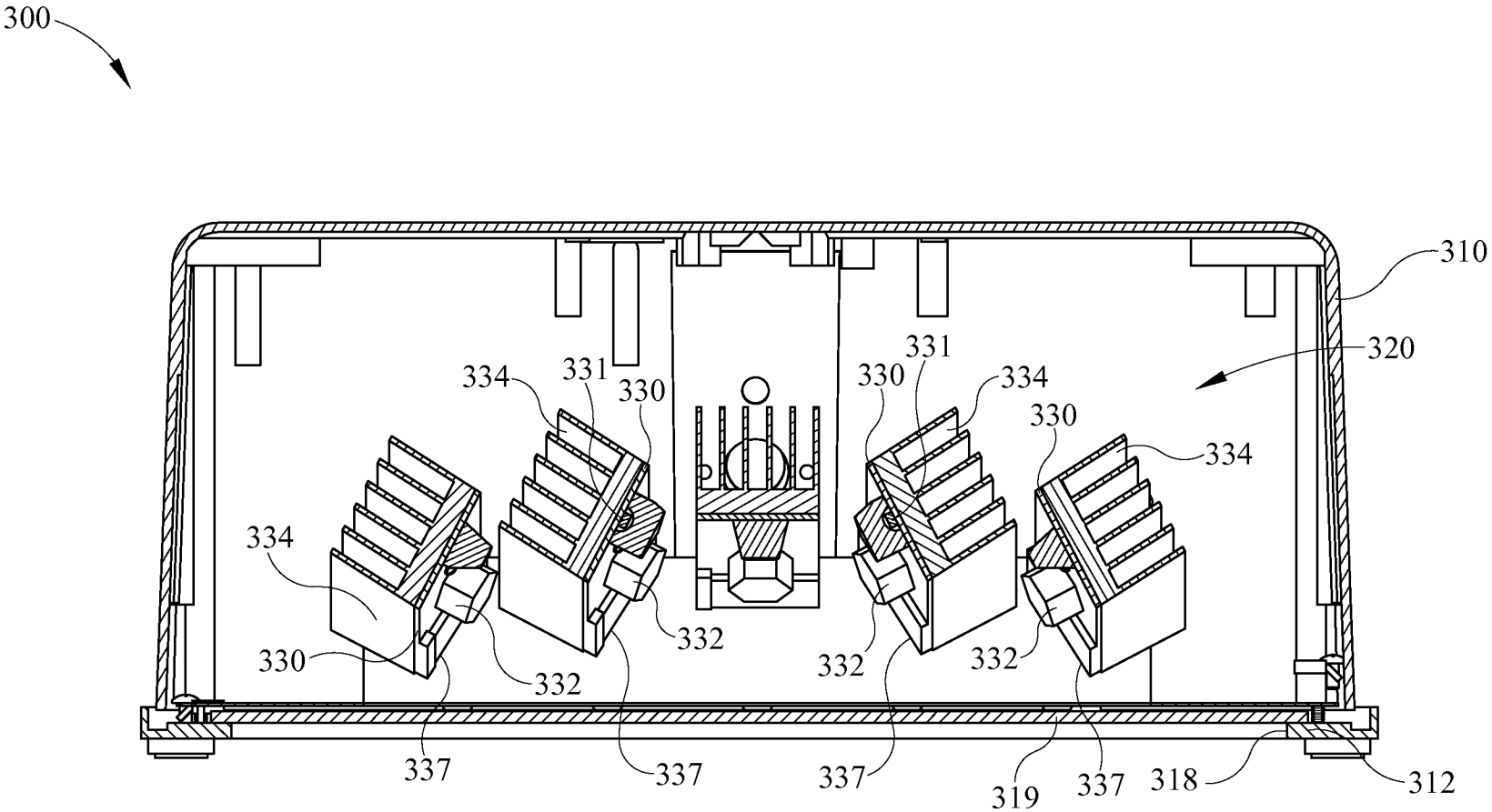
FIG. 10 is a front view, in section, of the LED luminaire of FIG. 9 taken along the section line 10-10 of FIG. 9.
Figure 11:
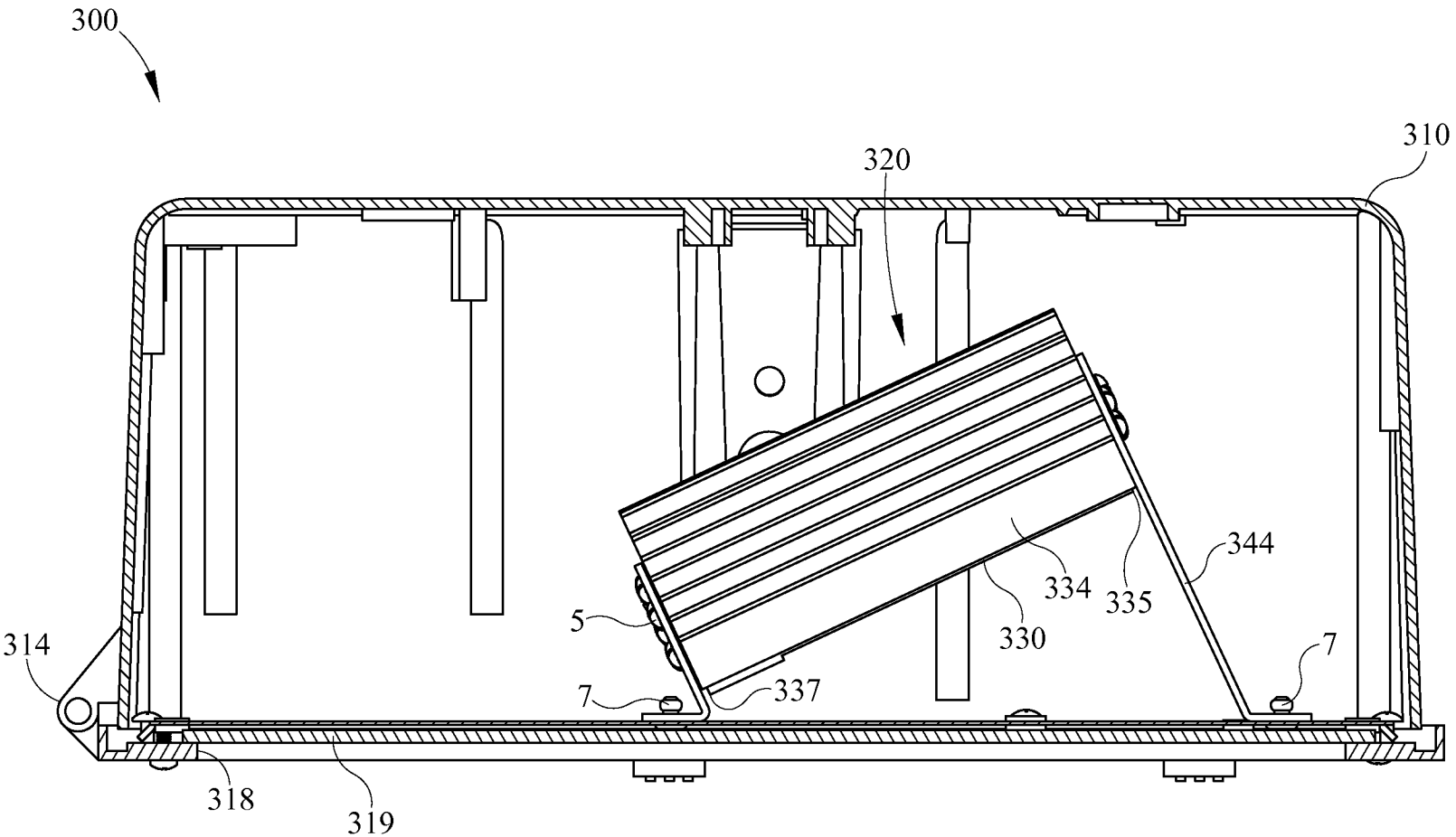
FIG. 11 is a side view, in section, of the LED luminaire of FIG. 9 taken along the line 11-11 of FIG. 9.

With reference to FIG. 9 through FIG. 11, a third embodiment of a LED luminaire 300 is depicted. LED Luminaire 300 has a housing having an upper housing portion 310 and a lower housing portion 312 that surround an LED structure 320. In some embodiments the housing is a FL70 casting manufactured by QSSI. Light emitted by LED structure 320 exits the housing portion through light exit aperture 318, which in the depicted embodiment is formed in lower housing portion 312. Light exit aperture 318 defines a plane through which light exits LED luminaire 300. In some embodiments a lens 319 may be provided to fully enclose the housing and/or to alter optical characteristics of light exiting LED luminaire 300. LED luminaire 300 is adapted to be secured to a junction box, ceiling, or other mounting surface. Lower housing portion 312 is designed to removably engage upper housing portion 310. A wire throughway 315 extends through upper housing portion 310 and allows electrical wiring into LED luminaire 300 to provide power to LED structure 320. In some embodiments electrical wiring entering LED luminaire 300 may directly feed LED structure 320. In some embodiments electrical wiring entering LED luminaire 300 may feed a sixty watt power supply within LED luminaire 200, which then feeds LED structure 220. In some embodiments the sixty watt power supply may be manufactured by Heyboer Transformers, part number HTS-9162. For simplification no power supply is shown in LED luminaire 300 or any other embodiments, but it is understood that power supplies may be easily included in any housings of the described embodiments.

With particular reference to FIG. 9 and FIG. 10, LED structure 320 has five LED strips, each having an LED board 330 in thermal connectivity with a heatsink 334. In the depicted embodiment of LED luminaire 300 heatsink 334 is an extruded aluminum heatsink manufactured by Aavid Thermalloy and is part number 61215 in their catalog. The heatsink has been cut to a length of 5.75" and appropriate apertures have been drilled therein for attaching LED boards 330 to heatsink 334 and for attaching heatsink 334 to a first portion 344 of a master frame and a second portion 342 of the master frame, as described in more detail herein. In other embodiments alternative heatsink configurations may be used, or heatsinks may be omitted altogether if not desired for heat dissipation. Each LED board 330 has four LEDs 331 and corresponding optical pieces 332 paired with each LED 331. Although four LEDs 331 in a particular arrangement on LED board 330 are depicted, in other embodiments the number, configuration, and/or arrangement of LEDs 331 and/or LED board 330 may vary. Also, in other embodiments some or all of LEDs 331 on LED boards 330 may be provided without a corresponding optical piece 332.

As described with the first and second embodiments, each optical piece 332 on an LED board 330 may be individually configured to produce a given beam distribution when coupled with a given LED 331. Each optical piece 332 and LED 331 may be individually configured based on its orientation and positioning within LED luminaire 300. For example, in some embodiments all four LED optical pieces 232 on the two outermost LED boards 330 are six degree LED collimator lenses. In some embodiments the six degree optical pieces are Manufactured by Polymer Optics and are part number 320 in their catalog. Again, "six degrees" refers to the half angle of the collimator lenses and not the full angle. In some embodiments all four LED optical pieces 332 on the two LED boards 330 immediately adjacent the center LED board 330 are twenty five degree LED collimator lenses. In some embodiments the twenty five degree optical pieces are Manufactured by Polymer Optics and are part number 324 in their catalog. Again, "twenty five degrees" refers to the half angle of the collimator lenses and not the full angle. In some embodiment the LED optical pieces 332 on the center LED board 330 are twenty five degree LED collimator lenses. Other configurations of optical pieces 332 and/or LEDs 331 are contemplated and may be utilized to obtain desired optical output by LED luminaire 300.

Each LED board 330 and heatsink 334 is coupled between a first portion 344 of a master frame and a second portion 342 of the master frame. Screws 5 extend through apertures in second portion 342 and secure each heatsink 334 to second portion 342. In other embodiments LED board 330 and/or heatsink 334 may be welded or otherwise coupled to second portion 342. Similar couplings can be used between heatsink 334 and first portion 344. Second portion 342 is fastened to lower housing 312 by fasteners 7 and first portion 344 is also fastened to lower housing 312 by fasteners 7. In other embodiments first portion 344 and/or second portion 342 may be otherwise secured to upper housing 310 and/or lower housing 312. An axis extends through the center of each LED board 330 from a first end 335 of LED board 330 proximal to first portion 344 to a second end 337 of LED board 330 proximal to second portion 342.

With particular reference to FIG. 10, it can be seen that the middle LED board 330 is adjusted about its axis to a first orientation, two of the LED boards 330 on a first side of the center LED board 330 are adjusted about their axes to a second orientation, and two of the LED boards 330 on a second side of the middle LED board 330 are adjusted about their axes to a third orientation. The LED boards 330 on a first side of the middle LED board 330 are adjusted about their axes to an orientation that is approximately sixty degrees off in a first direction from the orientation of the center LED board 330. The LED boards 330 on a second side of the middle LED board 330 are adjusted about their axes to an orientation that is approximately sixty degrees off in a second direction from the orientation of the center LED board 330. With particular reference to FIG. 9 it can be seen that the axes corresponding to LED boards 330 are substantially parallel with respect to one another.

With particular reference to FIG. 11, it can further be seen that the axes of LED boards 330 are at approximately a twenty-five degree angle with respect to the plane defined by light exit aperture 318. In other embodiments the axes of the LED boards 330 may be at a variety of angles with respect to the plane defined by light exit aperture 318. For example, in some embodiments the axes of two LED boards may be at twenty degree angles, the axes of two LED boards may be at ten degree angles, and the axis of one LED board may be parallel to the plane defined by light exit aperture 318. The axes of LED boards 330 do not all lie in the same plane. Although the axes of all LED boards 330 are at substantially the same angle with respect to light exit aperture 318, the axes of the two exterior LED boards 330 are positioned closer to light exit aperture 318 than the axes of other three LED boards 330. Although approximate positionings of each LED board 330 have been described, other positionings may be used to obtain desired optical output from LED luminaire 300. In other embodiments the two LED boards 330 immediately adjacent the center LED board 330 may be adjusted about their axes to an orientation that is approximately forty-five degrees off from the orientation of the center LED board 330 and the two outermost LED boards 330 may be adjusted about their axes to an orientation that is approximately sixty degrees off from the orientation of the center LED board 330.

Figure 12:
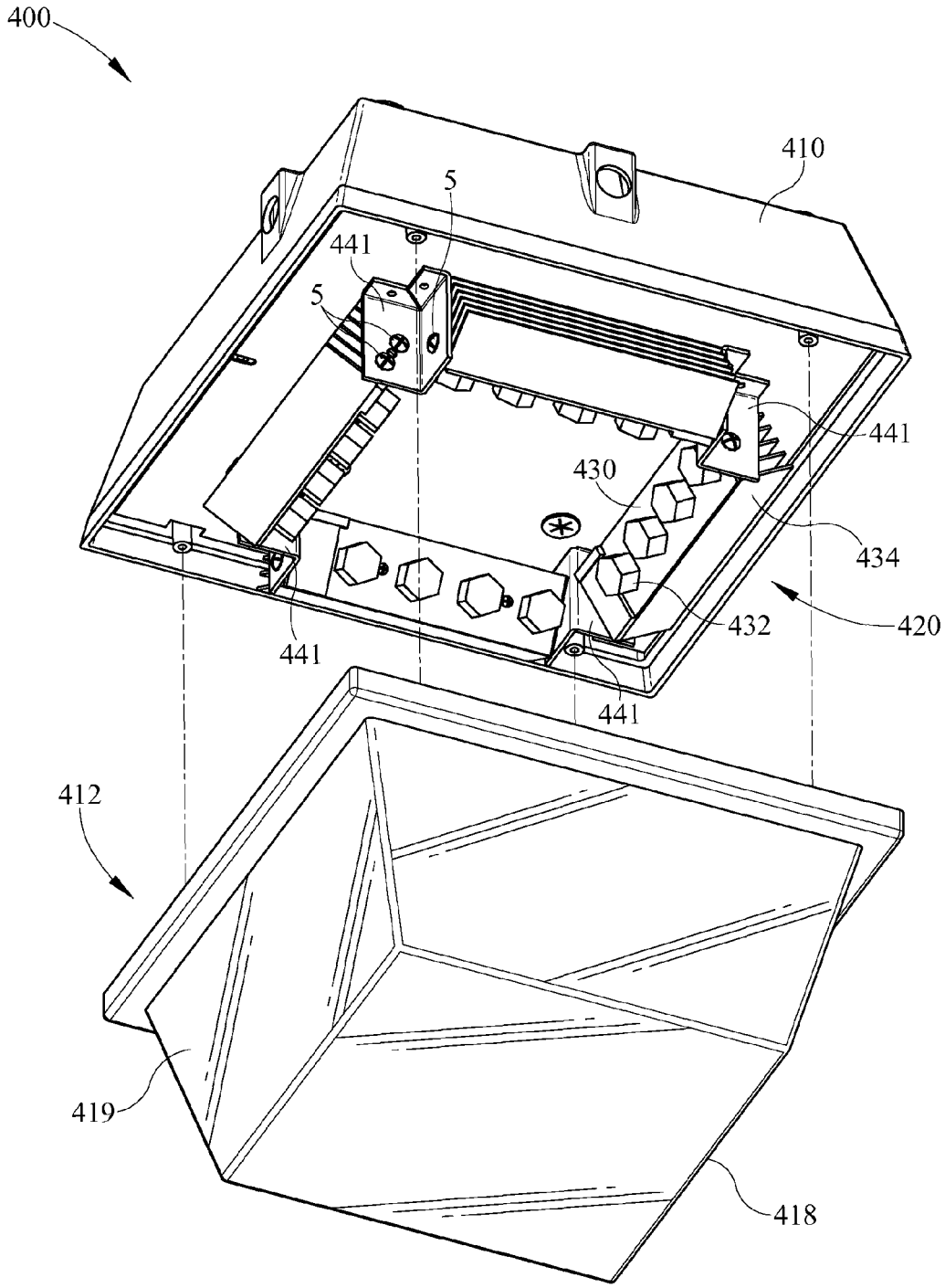
FIG. 12 is a perspective view of a fourth embodiment of the LED luminaire of the present invention shown with a lens exploded away.
Figure 13:
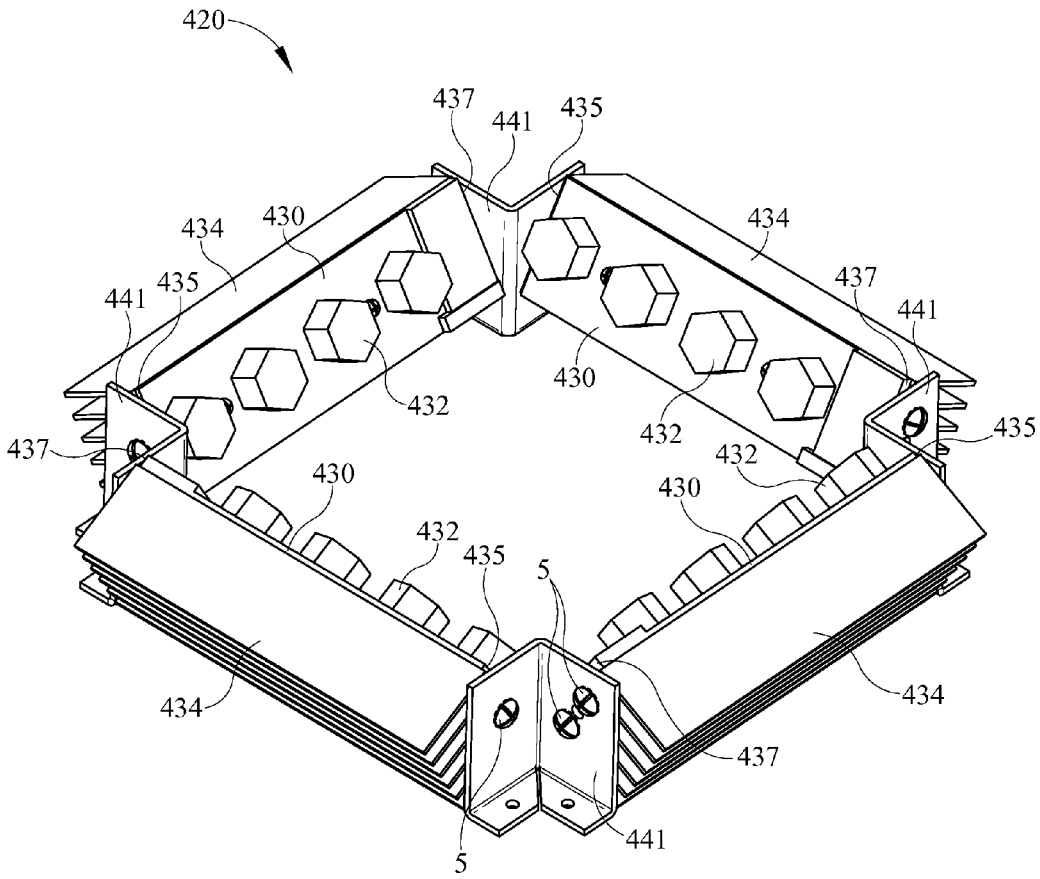
FIG. 13 is a perspective view of a LED structure of the LED luminaire of FIG. 12.

With reference to FIG. 12 and FIG. 13, a fourth embodiment of a LED luminaire 400 is depicted. LED Luminaire 400 has a housing having an upper housing portion 410 and a lower housing portion 412 that surround an LED structure 420. Light emitted by LED structure 420 exits the housing portion through a lens 419, which in the depicted embodiment is formed in lower housing portion 412. Light exit aperture 418 defines a plane through which light exits LED luminaire 400 and is at the base of lens 419 in this embodiment. Light will exit LED luminaire 400 through other portions of lens 419 as well, but light exit aperture 418 still defines a plane through which light exits LED luminaire 400. In the embodiment of FIG. 12, a majority of light will exit the plane defined by light exit aperture 418. LED luminaire 400 is adapted to be secured to a junction box, ceiling, or other mounting surface. Lower housing portion 412 is designed to removably engage upper housing portion 410. For simplification no power supply is shown in LED luminaire 400 or any other embodiments, but it is understood that power supplies may be easily included in any housings of the described embodiments.

With particular reference to FIG. 13, LED structure 420 has four LED strips, each having an LED board 430 in thermal connectivity with a heatsink 434. In other embodiments alternative heatsink configurations may be used, or heatsinks may be omitted altogether if not desired for heat dissipation. Each LED board 430 has four LEDs 431 and corresponding optical pieces 432 paired with each LED 431. Although four LEDs 431 in a particular arrangement on LED board 430 are depicted, in other embodiments, the number and/or arrangement of LEDs 431 on each LED board 430 may vary. Also, in other embodiments some or all of LEDs 431 on LED boards 430 may be provided without a corresponding optical piece 432.

As described with the first, second, and third embodiments, each optical piece 432 on an LED board 430 may be individually configured to produce a given beam distribution when coupled with a given LED 431. Each optical piece 432 and LED 431 may be individually configured based on their orientation and positioning within LED luminaire 400. Each LED board 430 and heatsink 434 is coupled between two corner frame portions 441 by fasteners 5. Corner frame portions 441 are coupled to upper housing 410. In other embodiments LED board 430 and/or heatsink 434 may be otherwise secured to upper housing 410 and/or lower housing 412. An axis extends through the center of each LED board 430 extending from a first end 435 of LED board 430 to a second end 437 of LED board 430.

The axes of LED boards 430 in the embodiment of FIG. 12 and FIG. 13 are approximately parallel with respect to the plane defined by light exit aperture 418. Also, the axes corresponding to each LED board 430 are at substantially perpendicular angles with respect to one another. Each LED board 430 is adjusted about its axis approximately sixty degrees with respect to the plane defined by light exit aperture 418. Each LED board 430 is adjusted about its axis to a unique orientation. Although approximate positionings of each LED board 430 have been described, other positionings may be used to obtain desired optical output from LED luminaire 400.

Figure 14:
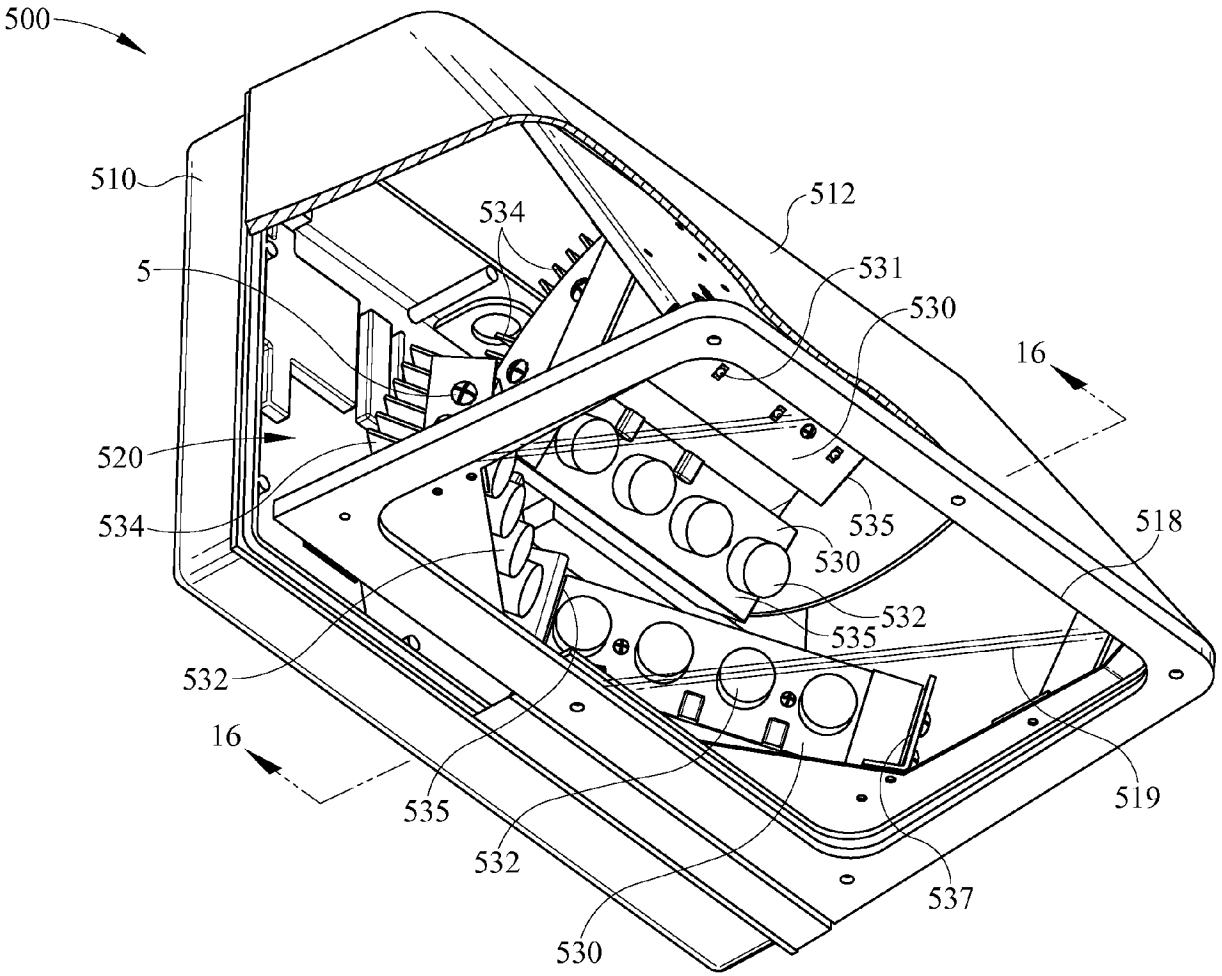
FIG. 14 is a perspective view of a fifth embodiment of the LED luminaire of the present invention shown with a portion of a front housing broken away.
Figure 15:
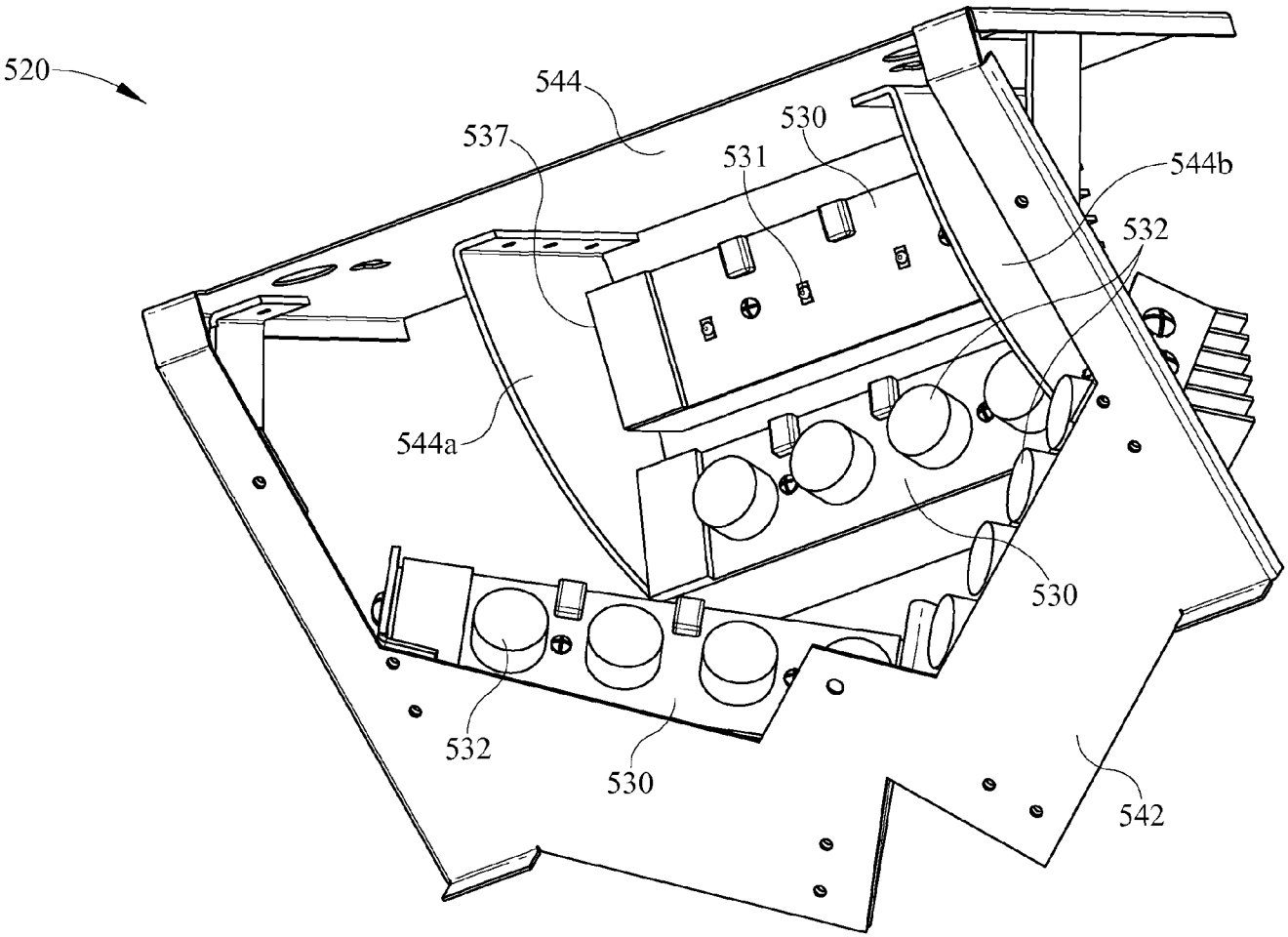
FIG. 15 is a perspective view of a LED structure of the LED luminaire of FIG. 14.
Figure 16:
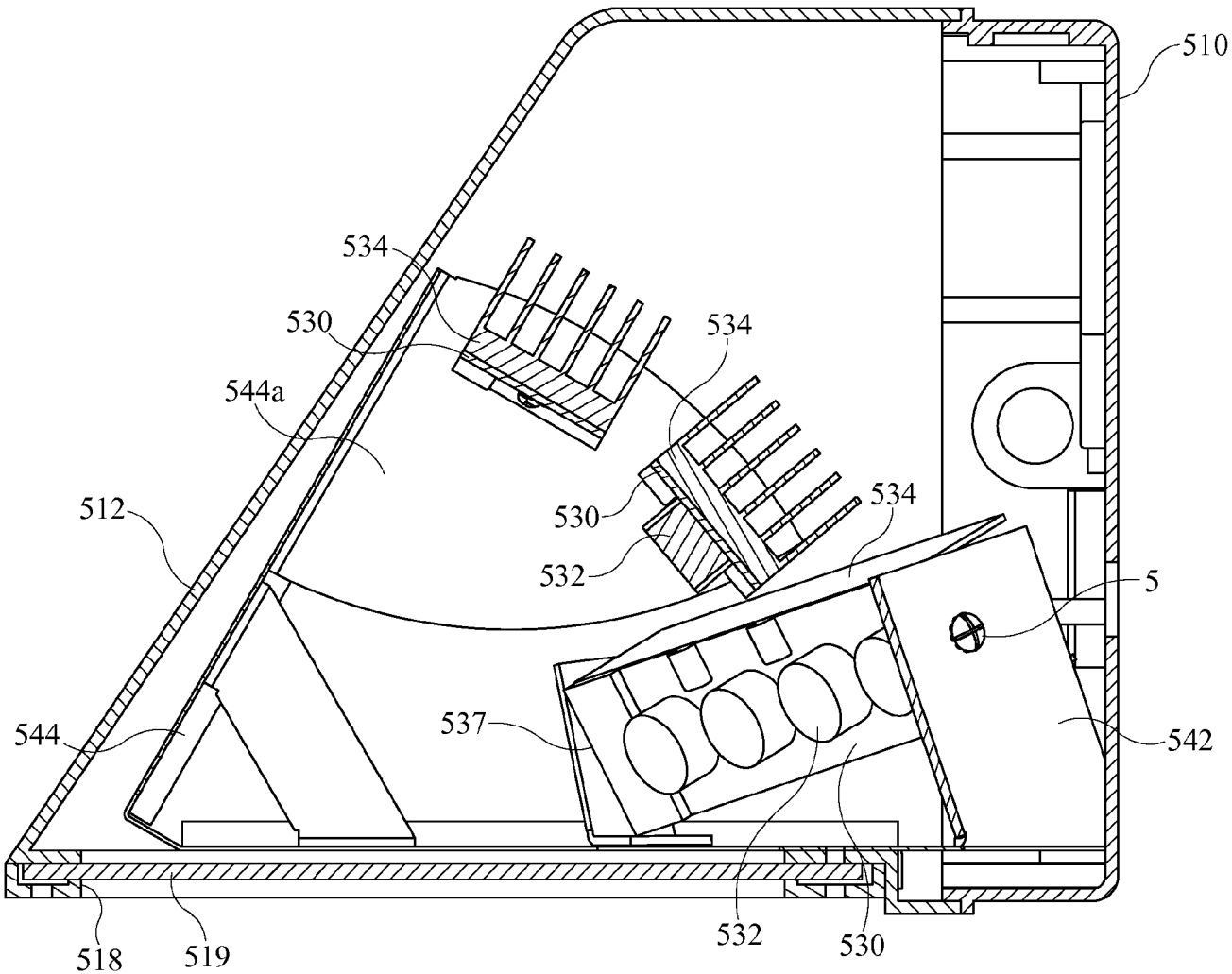
FIG. 16 is a side view, in section, of the LED luminaire of FIG. 14, taken along the line 16-16 of FIG. 14.

With reference to FIG. 14 through FIG. 16, a fifth embodiment of a LED luminaire 500 is depicted. LED Luminaire 500 has a housing having a rear housing portion 510 and a front housing portion 512 that surround an LED structure 520. In the depicted embodiment the housing is a WPC15 model number housing manufactured by QSSI. Light emitted by LED structure 520 exits the housing portion through light exit aperture 518, which in the depicted embodiment is formed in front housing portion 512. Light exit aperture 518 defines a plane through which light exits LED luminaire 500. In some embodiments a lens 519 may be provided to fully enclose the housing and/or to alter optical characteristics of light exiting LED luminaire 500. LED luminaire 500 is adapted to be secured to a junction box, wall, or other mounting surface. Lower housing portion 512 is designed to removably engage upper housing portion 510. In some embodiments electrical wiring entering LED luminaire 500 may directly feed LED structure 520. In some embodiments electrical wiring entering LED luminaire 500 may feed a sixty watt power supply within LED luminaire 500, which then feeds LED structure 520. In some embodiments the sixty watt power supply may be manufactured by Heyboer Transformers, part number HTS-9162. For simplification no power supply is shown in LED luminaire 500 or any other embodiments, but it is understood that power supplies may be easily included in any housings of the described embodiments.

LED structure 520 has four LED strips, each having an LED board 530 in thermal connectivity with a heatsink 534. In the depicted embodiment of LED luminaire 500 heatsink 534 is an extruded aluminum heatsink manufactured by Aavid Thermalloy and is part number 61215 in their catalog. The heatsink has been cut to a length of 5.75" and appropriate apertures have been drilled therein for attaching LED boards 530 to heatsink 534 and for attaching heatsink 534 to a first portion 544 of a master frame and a second portion 542 of the master frame, as described in more detail herein. In other embodiments alternative heatsink configurations may be used, or heatsinks may be omitted altogether if not desired for heat dissipation.

Each LED board 530 has four LEDs 531 and corresponding optical pieces 532 paired with each LED 531. In the depicted embodiment LEDs 531 are Luxeon Rebels part number LXML-PWN1-0080 having a Kelvin Color Temperature of approximately 4100K. Each LED is driven by a power supply at approximately 500 mA of current. In the depicted embodiment LED board 530 is a Thermalume metal core printed circuit board manufactured by Midwest Circuits and measures approximately 5.75" by 1.63". The LED board 530 positioned farthest away from light exit aperture 518 does not have optical pieces 532 paired with its LEDs 531. Although four LEDs 531 in a particular arrangement on LED boards 530 are depicted, in other embodiments the number, configuration and/or arrangement of LEDs 531 and/or LED boards 530 may vary.

As described with the first, second, third, and fourth embodiments, each optical piece 532 on an LED board 530 may be individually configured to produce a given beam distribution when coupled with a given LED 531. Each optical piece 532 and LED 531 may be individually configured depending on its orientation and positioning within LED luminaire 500. For example, in some embodiments the LED board 530 positioned farthest away from light exit aperture 518 does not have optical pieces 532 paired with its LEDs 531. In some embodiments all four LED optical pieces 232 on the other three LED boards 530 are twenty-five degree LED collimator lenses. In some embodiments the twenty-five degree optical pieces are Manufactured by Polymer Optics and are part number 124 in their catalog. Again, "twenty-five degrees" refers to the half angle of the collimator lenses and not the full angle. Other configurations of optical pieces 532 and/or LEDs 531 are contemplated and may be utilized to obtain desired optical output by LED luminaire 500.

Each LED board 530 and heatsink 534 is coupled to either first portion 544 of a master frame or a second portion 542 of the master frame. Two LED boards 530 are coupled between a first extension **544*a* and a second extension 544*b* of first portion 544 of the master frame. Screws 5 may extend through apertures in second portion 542 and/or first portion 544 to secure each heatsink 534. In other embodiments LED board 530 and/or heatsink 534 may be welded or otherwise coupled to the master frame and/or the housing. Similar couplings can be used between heatsink 334 and first portion 344. Second portion 542 is fastened to front housing 512 and first portion 544 is also fastened to front housing 512. In other embodiments first portion 544 and/or second portion 542 may be otherwise secured to upper housing 510 and/or lower housing 512. An axis extends through the center of each LED board 530 from a first end 535 of LED board 530 proximal to first portion 544 to a second end 537 of LED board 530 proximal to second portion 542**.

The LED board 530 positioned farthest away from light exit aperture 518 is adjusted about its axis such that LED board 530 is at approximately a forty degree angle with respect to the plane defined by light exit aperture 518. The axis of LED board 530 positioned farthest away from light exit aperture 518 is substantially parallel with light exit aperture 518. The LED board 530 positioned adjacent to the LED board 530 that is farthest away from light exit aperture 518 is adjusted about its axis such that the LED board 530 is at approximately a sixty degree angle with respect to the plane defined by light exit aperture 518. The axis of LED board 530 positioned adjacent to the LED board 530 that is farthest away from light exit aperture 518 is substantially parallel with light exit aperture 518. The remaining two LED boards 530 are adjusted about their axes such that LED board 530 is at approximately a forty-seven degree angle with respect to the plane defined by light exit aperture 518. The axes of the remaining two LED boards 530 are at an angle of approximately eleven degrees with respect to light exit aperture 518.

The foregoing description has been presented for purposes of illustration. It is not intended to be exhaustive or to limit the invention to the precise forms disclosed, and obviously many modifications and variations are possible in light of the above teaching. It is understood that while certain forms of the LED luminaire have been illustrated and described, it is not limited thereto except insofar as such limitations are included in the following claims and allowable functional equivalents thereof

We claim:

1. A luminaire comprising:

a housing having a light exit aperture lying in a first plane;

at least three LED boards mounted within said housing and electrically connected to a power supply, each said LED board having a first end and a second end opposite said first end, an axis extending from said first end to said second end, and a surface extending from said first end to said second end, said surface having at least one light emitting diode thereon;

each of said LED boards combined with a heat sink;

wherein each of said LED boards is adjusted about its respective said axis to an orientation that is unique from at least two other said LED boards;

wherein a plurality of said axes of said LED boards are at a non-parallel angle with respect to said first plane;

a master frame coupled to said housing, said master frame including a first portion of said master frame and a second portion of said master frame in a substantially V-shaped configuration with said second portion below said first portion and adjacent said light exit aperture; said light exit aperture positioned between said first portion of said master frame and said second portion of said master frame; and a first extension of said first portion and a second extension of said first portion, a first and a second of said at least three LED boards mounted between said first and second extension of said first portion, said first and said second LED boards mounted above said light exit aperture; a third of said at least three LED boards mounted on said second portion of said master frame adjacent said light exit aperture and substantially below said first and said second LED board.

2. The luminaire of claim 1, wherein said axes corresponding to said LED boards are all at a common said non-parallel angle with respect to said first plane.

3. The luminaire of claim 1, wherein said axis corresponding to each said LED board is at a twenty to thirty degree said non-parallel angle with respect to said first plane.

4. The luminaire of claim 1, further comprising a plurality of optical pieces, each said optical piece paired with a single said light emitting diode.

5. The luminaire of claim 4, wherein at least one said optical piece includes a collimator lens having a first distribution angle and wherein at least one optical piece includes a collimator lens having a second distribution angle, said first distribution angle being distinct from said second distribution angle.

6. The luminaire of claim 1, wherein said axes of two or more said LED boards are non-parallel to one another.

7. The luminaire of claim 1, wherein said axes of at least two said LED boards lie in a second plane and said axis of at least one said LED board does not lie in said second plane.

8. The luminaire of claim 1, wherein each said axis lies in the center of a corresponding said LED board.

9. A luminaire comprising:

a housing having a light exit aperture lying in a first plane;

a plurality of LED boards mounted within said housing and electrically connected to a power supply, each said LED board having a first end and a second end opposite said first end, an axis extending from said first end to said second end, a surface extending from said first end to said second end, said surface having a plurality of light emitting diodes thereon;

wherein each said LED board is fixedly adjusted about its respective said axis to an orientation that is unique from at least two other said LED boards; and wherein said axis of at least one said LED board extends in a first direction and said axis of at least one said LED board extends in a second direction, said second direction being non-parallel to said first direction a master frame coupled to said housing, said master frame including at least one pair of opposed mounting extensions on a first portion opposite said light exit aperture, at least two of said LED boards mounted and interposed between a single of said at least one pair of opposed mounting extensions;

a second portion of said master frame opposite said first portion and retaining at least one of said plurality of LED boards adjacent said light exit aperture;

wherein said master frame is retained within said housing, said light exit aperture extending substantially between said first portion and said second portion of said mounting frame.

10. The luminaire of claim 9, further comprising a plurality of heatsinks, each said heatsink in thermal connectivity with a single said LED board.

11. The luminaire of claim 10, wherein a plurality of said axes of said LED boards are at a non-parallel angle with respect to said first plane.

12. The luminaire of claim 10, further comprising a plurality of optical pieces, each said optical piece paired with a single said light emitting diode.

13. The luminaire of claim 12, wherein at least one said LED board is provided without any said optical pieces.

14. The luminaire of claim 10, wherein said axes corresponding to said LED boards are all at a common said non-parallel angle with respect to said first plane.

15. The luminaire of claim 9, wherein each said axis corresponding to each said LED board is at a twenty to forty degree angle with respect to said first plane.

16. The luminaire of claim 9, wherein said second direction is perpendicular to said first direction.

17. The luminaire of claim 9, wherein each said LED board is fixedly adjusted about its respective said axis to an orientation that is unique from any other said LED board.

18. The luminaire of claim 9, wherein at least three LED boards are provided and wherein said axes of at least two said LED boards lie in a second plane and said axis of at least one said LED board does not lie in said second plane.

19. A luminaire comprising:

a housing having a light exit aperture;

a master frame coupled to said housing and located within said housing and having a first portion and a second portion in substantially V-shaped configuration with said light exit aperture extending therebetween, said first portion of said master frame having a pair of opposing extensions;

a plurality of LED boards mounted to said master frame and electrically connected to a power supply, each said LED board having a first end and a second end opposite said first end, an axis extending from said first end to said second end, a first surface and a second surface extending from said first end to said second end, said first surface having at least one light emitting diode thereon, each said second surface having a heatsink coupled thereto;

wherein each of said LED boards and a corresponding said heatsink is wholly interposed between opposed portions of said master frame;

wherein each said LED board is adjustable about its respective said axis to an orientation that is unique from at least two other said LED boards; and wherein a plurality of said axes of said LED boards are at a non-parallel angle with respect to said light exit aperture;

at least a first and a second LED board of said plurality of LED boards mounted between said pair of opposing extensions above at least a third LED board of said plurality of LED boards, said third LED board mounted on said second portion adjacent said light exit aperture and below said first and second LED board.

20. The luminaire of claim 19, wherein said axes of said LED boards are all at a common said non-parallel angle with respect to said light exit aperture.

21. The luminaire of claim 19, wherein each said LED board is adjusted about its respective said axis to an orientation that is unique from any other said LED board.

22. The luminaire of claim 19, further comprising a plurality of optical pieces, each said optical piece paired with a single said light emitting diode.

23. The luminaire of claim 22, wherein at least one said optical piece includes a collimator lens having a first distribution angle and wherein at least one optical piece includes a collimator lens having a second distribution angle, said first distribution angle being distinct from said second distribution angle.

24. The luminaire of claim 23, wherein at least one said optical piece includes a collimator lens having a third distribution angle, said third distribution angle being distinct from said first distribution angle and said second distribution angle.

25. The luminaire of claim 19, wherein said axes of a plurality of said LED boards are at non-parallel angles with respect to one another.

26. The luminaire of claim 23, wherein said axes of at least two said LED boards are at forty-five to ninety degree said non-parallel angles with respect to one another.

* * * * *